United States Patent [19]

Ryu et al.

[11] Patent Number: 4,986,483

[45] Date of Patent: Jan. 22, 1991

[54] WINDER OF SYNTHETIC YARN, CHEESE-LIKE YARN PACKAGE OF SYNTHETIC YARN, AND METHOD FOR WINDING THE SAME

[75] Inventors: Ushio Ryu; Hideo Ono; Kengi Kabashima; Yutaka Masushige; Teruhiko Matsuo; Tadashi Koyanagi, all of Nobeoka, Japan

[73] Assignee: Asahi Kasei Kogyo Kabushiki Kaisha, Japan

[21] Appl. No.: 449,058

[22] Filed: Dec. 18, 1989

Related U.S. Application Data

[63] Continuation of Ser. No. 308,947, Feb. 8, 1989, abandoned, which is a continuation of Ser. No. 32,714, Apr. 1, 1987, abandoned.

[30] Foreign Application Priority Data

| | | | |
|---|---|---|---|
| Apr. 9, 1986 | [JP] | Japan | 61-800622 |
| Apr. 10, 1986 | [JP] | Japan | 61-81204 |
| Apr. 14, 1986 | [JP] | Japan | 61-84088 |
| Apr. 14, 1986 | [JP] | Japan | 61-84086 |

[51] Int. Cl.[5] ..... B65H 59/00; B65H 54/00; B65H 54/38; B65H 55/00

[52] U.S. Cl. ..... 242/45; 242/18 R; 242/18.1; 242/43 R; 242/159; 242/174; 242/178

[58] Field of Search ..... 242/45, 18 R, 18 DD, 242/18.1, 18 CS, 26, 43 R, 43.1, 159, 174, 175, 176, 177, 178

[56] References Cited

U.S. PATENT DOCUMENTS

| | | | |
|---|---|---|---|
| 2,950,067 | 8/1960 | Keith | 242/45 |
| 3,288,383 | 11/1966 | Muller . | |
| 3,310,248 | 3/1967 | Have | 242/43 R |
| 3,536,272 | 10/1970 | Ueyama | 242/45 |
| 3,690,579 | 9/1972 | Porter | 242/18.1 X |
| 3,717,311 | 2/1973 | Smith | 242/18 R |
| 3,860,187 | 1/1975 | Liska et al. | 242/45 |
| 4,069,985 | 1/1978 | Lohest et al. | 242/45 |
| 4,134,882 | 1/1979 | Frankfort et al. . | |
| 4,156,071 | 5/1979 | Knox . | |
| 4,195,051 | 3/1980 | Frankfort et al. . | |
| 4,307,848 | 12/1981 | Barathieu | 242/18 R |
| 4,390,685 | 6/1983 | Oka et al. . | |
| 4,415,726 | 11/1983 | Tanji et al. . | |
| 4,426,516 | 1/1984 | Kuriki et al. . | |
| 4,456,575 | 6/1984 | Smith et al. . | |
| 4,498,637 | 2/1985 | Yamamoto et al. | 242/18.1 |
| 4,544,113 | 10/1985 | Yoshinaga et al. | 242/43 R |
| 4,674,694 | 6/1987 | Hasegawa et al. | 242/18.1 |

FOREIGN PATENT DOCUMENTS

| | | |
|---|---|---|
| 0094483 | 3/1983 | European Pat. Off. . |
| 0095712 | 4/1987 | European Pat. Off. . |
| 49-6495 | 2/1974 | Japan . |
| 50-22130 | 7/1975 | Japan . |
| 50-83544 | 7/1975 | Japan . |
| 56-127558 | 10/1981 | Japan . |
| 58-208415 | 12/1983 | Japan . |
| 58-208416 | 12/1983 | Japan . |
| 60-167855 | 8/1985 | Japan . |
| 60-209013 | 10/1985 | Japan . |
| 1441821 | 3/1973 | United Kingdom . |

*Primary Examiner*—Stanley N. Gilreath
*Attorney, Agent, or Firm*—Finnegan, Henderson, Farabow, Garrett & Dunner

[57] ABSTRACT

A bobbin-type winder for winding a synthetic yarn at a constant speed is disclosed. The winder includes a bobbin shaft having a bobbin mounted thereon and a bobbin shaft driving apparatus, operably connected to a first inverter, for rotating the bobbin shaft. The winder further includes a traverse device for traversing the yarn supplied to the bobbin, and a contacting roll arranged such that it is movable into contact with the circumferential face of a yarn package wound on the bobbin. The contacting roll is driven via a second inverter and a rotational speed detector is provided for detecting the rotational speed of the contacting roll. A controller is electrically connected with the bobbin shaft driving apparatus and the rotational speed detector for controlling the rotational speed of the bobbin shaft in accordance with the detector rotational speed of the contacting roll. The second inverter is isolated from the controller so that a torque applied from the outer surface of the yarn package to the contacting roll is minimized.

12 Claims, 11 Drawing Sheets

WINDER OF SYNTHETIC YARN, CHEESE-LIKE YARN PACKAGE OF SYNTHETIC YARN, AND METHOD FOR WINDING THE SAME

This application is a continuation of application Ser. No. 308,947, filed Feb. 8, 1989, now abandoned, which is a continuation of application Ser. No. 032,714, filed Apr. 1, 1987, now abandoned.

BACKGROUND OF THE INVENTION

1. Field of the Invention

The present invention relates to a winder of a synthetic yarn, a winding method, and cheese-like yarn package formed by the winder. More particularly, the present invention relates to a winder and a winding method capable of winding synthetic yarn at a high speed in a spinning process of synthetic yarn, and to a cheese yarn package having an excellent winding shape and a good yarn quality.

2. Description of the Related Art

A number of reports regarding high-speed production of synthetic yarns have been published during the past 10 and several years. Of special interest are the technique for manufacturing directly a yarn having practical physical properties by winding continuously a melt spun yarn into a yarn package and the technique of winding the yarn at a speed of at least 4,000 m/min, and sometimes from 8,000 m/min to 9,000 m/min. Such high-speed manufacture of synthetic yarn takes two systems: the so-called "spin take-up" process, in which the melt spun yarn is directly wound as a fully oriented yarn onto the yarn package without a drawing process, and the so-called "spin draw take-up" process, in which the melt spun yarn is wound onto the yarn package after a drawing process.

As described in U.S. Pat. Nos. 4,195,051, 4,156,071, 4,415,726, 4,426,516, and Japanese Unexamined Patent Publication (Kokai) No. 58-208416, the spin take-up process enables manufacture of a yarn dyeable under normal pressure, which is impossible with a conventional polyester yarn, by spinning the yarn at a speed of 7,000 m/min or more and winding it onto the yarn package.

The spin draw take-up process enables obtaining synthetic yarn with mechanical properties similar to those of conventional synthetic yarn by means of a high-speed winding process and is disclosed in U.S. Pat. Nos. 4,390,685 and 4,456,575.

In high-speed manufacture of synthetic yarn the high-speed causes several problems in the winding operation, e.g., inferior shape of the yarn package and irregularity of yarn quality along the lengthwise direction of the yarn as disclosed in "Journal of The Society of Fiber Science and Technology", Japan, vol. 38, No. 11. Solutions of the above problems are now under study.

When winding yarn onto a yarn package having a cheese-form, the yarn is traversed by a traverse device and wound through a contacting roll on a bobbin mounted on a bobbin shaft. Since the traversed yarn is reversed at a decreased speed at both ends of the yarn package, as is well known, a yarn dwell, i.e., yarn accumulation, is generated on the ends of the yarn package, so that the package protrudes outward at edges of end portions of the yarn package (hereinafter, referred to as "high-edge"). The diameter of the yarn package at the high-edge portions becomes slightly larger than at the middle portion. Also, the winding hardness at the high-edge portions becomes higher than at the middle portion. Therefore, during the winding operation, the yarn package is wound with only the high-edge portions pressed on the rotating contacting roll.

As driving systems for winding the yarn package, several systems may be mentioned, i.e., (1) a surface driving system, in which the contacting roll is driven, (2) a bobbin shaft driving system, in which the bobbin shaft is driven, and (3) a driving system, in which the contacting roll and the bobbin shaft are driven under cooperative control. In the above-mentioned systems (1) and (2), contact pressure is applied between the contacting roll and the yarn package, and a following member in the contacting roll or the yarn package is driven frictionally by the driving member. The contact pressure is determined as the force necessary to transmit a rotary motion to the following member without slippage and to maintain the yarn path of the yarn to be wound onto the yarn package. It is necessary to have a large contact pressure, especially for high-speed winding. This large contact pressure crushes the high-edge portions of the yarn package, resulting in bulges on the two end faces, so that the shape of the yarn package becomes inferior. Further the large contact pressure results in irregularities in the yarn quality, and irregularities in the corresponding period of the yarn between the two faces of the yarn package caused by the difference of internal stresses of the yarn prevailing in the yarn package. Further, in high-speed winding, slippage between the contacting roll and the yarn package and variation of the winding speed occur easily, further exacerbating the irregularities. When a dyeing-finishing process is applied to woven or knitted fabric fabricated from yarns of the yarn packages having the above-mentioned irregularities, the result is a flaw so-called "hikes," i.e. irregularities of brilliance caused by the weft or warp yarn running in the direction of the yarn on the woven or knitted fabric. Fabric having many "hikes" substantially lose value as merchandise. It is therefore important to eliminate "hikes" from the fabric.

There are several proposals in the related art to overcome the above-mentioned problems in the yarn package. For example, Japanese Examined Patent Publication (Kokoku) No. 49-6495 discloses a traverse cam having a specific track which is capable of decreasing the height of the high-edge portions. Japanese Examined Patent Publication (Kokoku) No. 50-22130 and Japanese Unexamined Patent Publication (Kokai) No. 60-167855 disclose a specific multi-track cam capable of traversing the yarn to disperse the high-edge portions. Japanese Unexamined Patent Publication (Kokai) No. 56-127558 discloses a scroll cam type traverse mechanism having a specific track capable of increasing the contacting area between the contacting roll and the yarn package. Japanese Unexamined Patent Publication (Kokai) No. 50-83544 discloses a method of gradually decreasing the contact pressure between the contacting roll and the yarn package.

However, when yarn is wound at a speed of 5,000 m/min or more by a conventional winder in which the above-mentioned traverse mechanism is adopted, and the yarn package is frictionally driven by a driven bobbin shaft, the yarn package sometimes collapses during the winding operation and so normal winding is difficult. Therefore the quality of the yarn package cannot be improved and it is sometimes impossible to form the yarn package.

U.S. Pat. No. 4,069,985 and 3,288,383 disclose a system in which the speed of a bobbin shaft driving means is controlled to achieve a constant winding speed by detecting the change of the power consumption of a contacting roll driving means. However, the power consumption changes by the heat generation of the contacting roll driving means, the change of the sliding resistance of bearings of the contacting roll driving means, and the like, so the above power consumption detection method is not able to keep the winding speed exactly the same, especially in the case of high-speed winding of 5,000 m/min or more.

Japanese Unexamined Patent Publication (Kokai) No. 60-209013 discloses a method for winding yarn in a noncontacting state between the yarn package and another member into a pirn-like yarn package by using a spindle driven winder. This related art suggests that improvement of the irregularities of yarn quality i.e., irregularities of "hike" and uneven dyeing, cannot be obtained by a winder having a contacting roll in which the yarn is traversed at a high speed.

Accordingly, a cheese package of synthetic yarn wound at a speed of 5,000 m/min or more having excellent shape stability and suffering from little "hike" defects when the yarn of the cheese package is directly used to manufacture a weaving fabric or a knitting fabric has not been found up to now.

SUMMARY OF THE INVENTION

It is a primary object of the present invention to provide a winding machine, capable of manufacturing by high-speed spinning of 5,000 m/min or more, a synthetic yarn giving a fabric in which "hikes" and uneven dyeing do not occur; a method for winding the above-mentioned synthetic yarn; and a cheese yarn package obtained by the above-mentioned winder or method.

A second object of the present invention is to provide a winder capable of manufacturing a cheese yarn package having less bulging on the end faces of the yarn package and smaller high-edge portions, and a method for winding yarn by using the above-mentioned winder.

A third object of the present invention is to provide a winder capable of achieving the above-mentioned first and second objects on the basis of corresponding applications in which the yarn is used, and a method for winding the yarn by using the above-mentioned winder.

Another object of the present invention is to provide a useful winding technique for enabling commercial production of a polyester filament yarn using the spin take-up process.

The objects of the present invention can be generally attained by a winder in which a driving means for driving a bobbin shaft having a bobbin mounted thereon and a driving means for driving a contacting roll rotating while contacting on a surface of a yarn package are independent of each other, and which is provided with means for detecting rotational speed of the contacting roll in a non-contact condition.

DESCRIPTION OF THE PREFERRED EMBODIMENTS

The present invention will now be described in detail referring to drawings illustrating embodiments of a winder and a cheese package in accordance with the invention.

Figure 1:
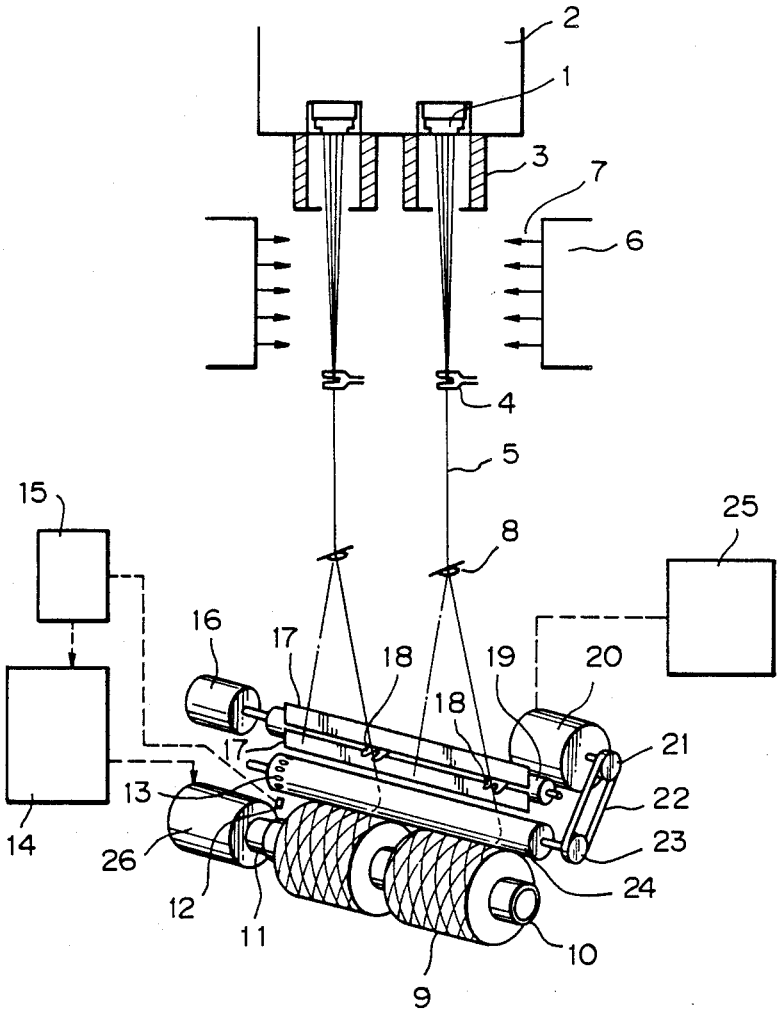
FIG. 1 is a schematic view of an embodiment of a winder in accordance with the present invention.

FIG. 1 illustrates an embodiment of a high-speed spinning apparatus utilizing a bobbin shaft driving type winder having a positively driven contacting roll and a multi-track cam, and with controlled rotational speed of the bobbin shaft.

The construction of the spinning portion of the high-speed spinning apparatus illustrated in FIG. 1 is similar to that of the spinning apparatus disclosed in Japanese Unexamined Patent Publication (Kokai) No. 58-208416. As shown in FIG. 1, a polymer is extruded from spinnerets 1 mounted on a uniformly heated spinning head 2 as a filament. This is slowly cooled and becomes thinner in a heating pipe tube 3, then is solidified by cooling air 7 blown from a duct 6. A plurality of filaments constituting a yarn 5 are gathered together given a finishing agent by an oiling nozzle 4. The yarn 5 is wound through a guide 8 arranged below the oiling nozzle 4 by the winder to make a yarn package 9.

In the winder illustrated in FIG. 1, a bobbin shaft 11 mounting a bobbin 10 is connected with a bobbin shaft driving means 26 connected with a second independent inverter 14, a contacting roll 24 supported in a bearing is mounted on a contacting roll housing (not shown), and a pulley 23 arranged on one end of the contacting roll 24 is driven through a belt 22 by a contacting roll driving means 20 such that the contacting roll 24 can be rotated by the driving force from the contacting roll driving means 20. A first independent inverter 25 is connected to the contacting roll driving means 20. A row of holes 13 used for detecting rotation of the contacting roll 24, is arranged on another end of the contacting roll 24. A non-contact type rotational speed detecting device 12 is arranged adjacent to the end arranged with the row of holes 13 of the contacting roll 24 and is connected to a controller 15 including a circuit performing calculations for controlling the rotational speed of the bobbin shaft and connected to the second independent inverter 14. Therefore, the controller 15 can control the rotational speed of the bobbin shaft, but cannot control the rotational speed of the contacting roll 24, because the first independent inverter 25 is not operably connected to the controller 15.

A traverse device 27 (see FIG. 2*a*) including a traverse cam 19, i.e., a cylindrical cam supported by a pair of bearings at the two ends thereof, and a yarn guide 18 one end of which is inserted into a groove of the traverse cam 19 and whose movement in a vertical direction is defined by a pair of rails 17, is arranged on an upward and front side position from the traverse cam 19. The traverse cam 19 is connected to a traverse cam driving device 16 connected with a traverse cam driving inverter (not shown).

Figure 2B:
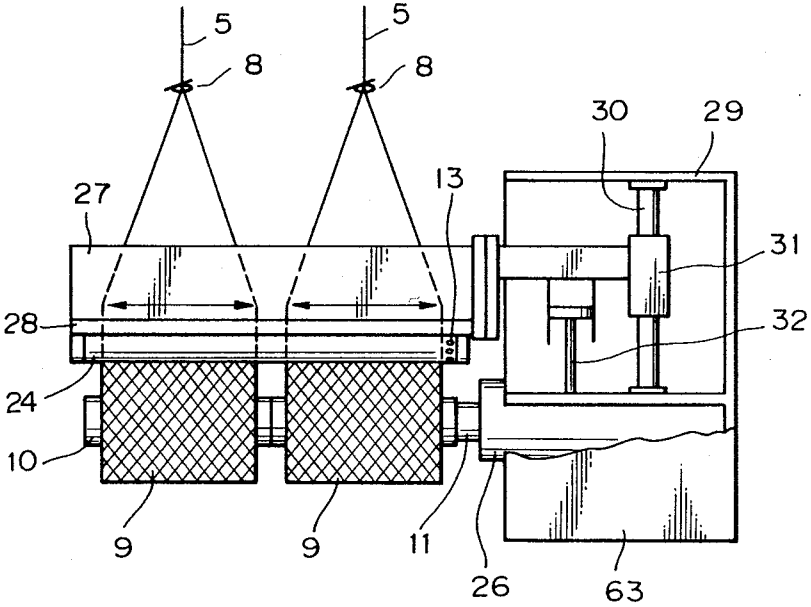
FIG. 2*b* is a side view of the winder illustrated in FIG. 2*a;*
Figure 2A:
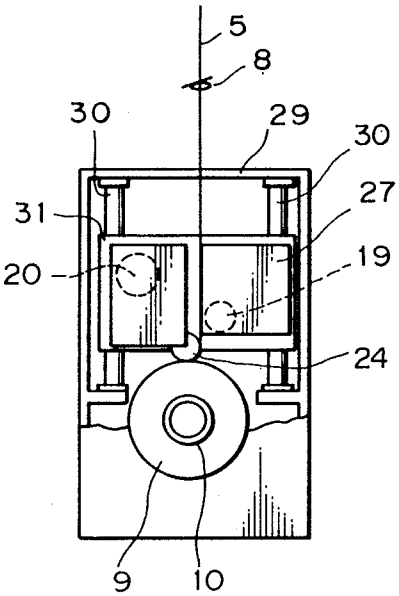
FIG. 2*a* is a front view of the winder illustrated in FIG. 1.

As shown in FIG. 2*a*, and 2*b* illustrate a mechanism for performing sliding movement of the traverse device 27, and a contacting roll housing 28 accommodating the contacting roll driving means 20 against the bobbin shaft 10. The traverse device 27 and the contacting roll housing 28 cooperate with a raising and descending base 31 accommodated within a frame 29 of the winder. Namely, the raising and descending base 31, supported by a bearing with the traverse device 27 and the contacting roll housing 28 is held slidably by a sliding shaft 30 accommodated in the frame 29 and is moved upward or downward by means of an air cylinder 32.

Figure 3:
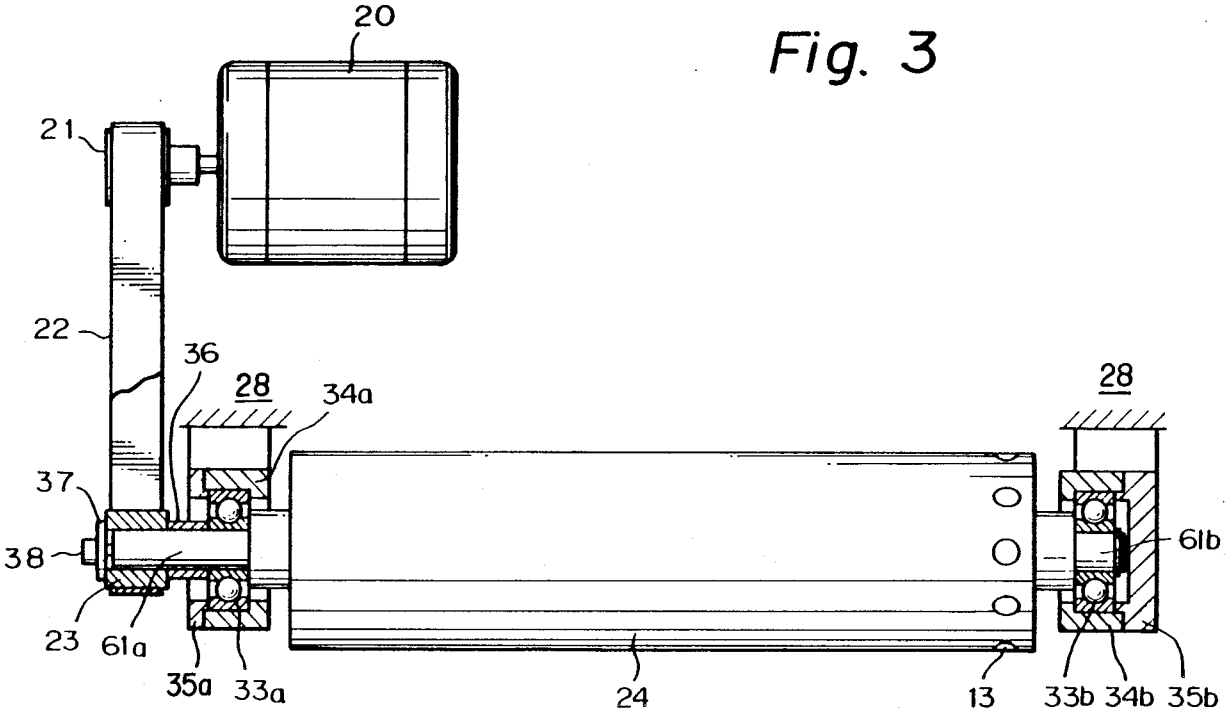
FIG. 3 is a side view illustrating in detail a contacting roll used in the winder illustrated in FIG. 1.

As shown in FIG. 3, illustrating in detail the construction of the contacting roll 24, shafts 61*a* and 61*b* protruding from the two ends of the contacting roll 24 are held through bearings 33*a* and 33*b* in bearing housings 34*a* and 34*b*, respectively. The bearing housings 34*a* and 34*b* are fixed on the contacting roll housing 28. Bearing covers 35*a* and 35*b* are useful for maintaining the bearings 33*a* and 33*b* in the bearing housings 34*a* and 34*b*. The pulley 23 is arranged on the shaft 61*a* by a collar 36 and a washer 37 and fixed by a screw 38. A belt 22 is arranged between the pulley 23 and a pulley 21 fixed on a motor 20. The row of holes 13 are arranged on the circumferential surface of the end portion of the contacting roll 24.

Figure 4:
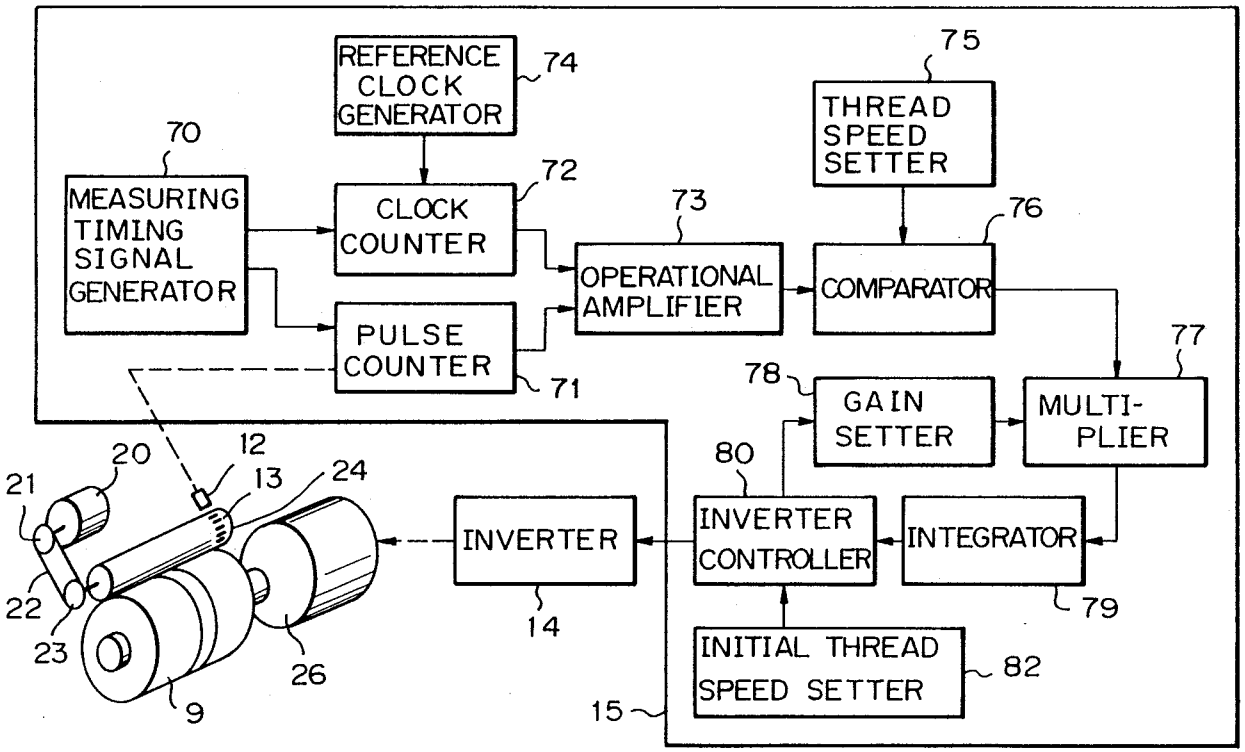
FIG. 4 is a block diagram explaining an embodiment of a controlling system of the winder in accordance with the present invention.
Figure 5:
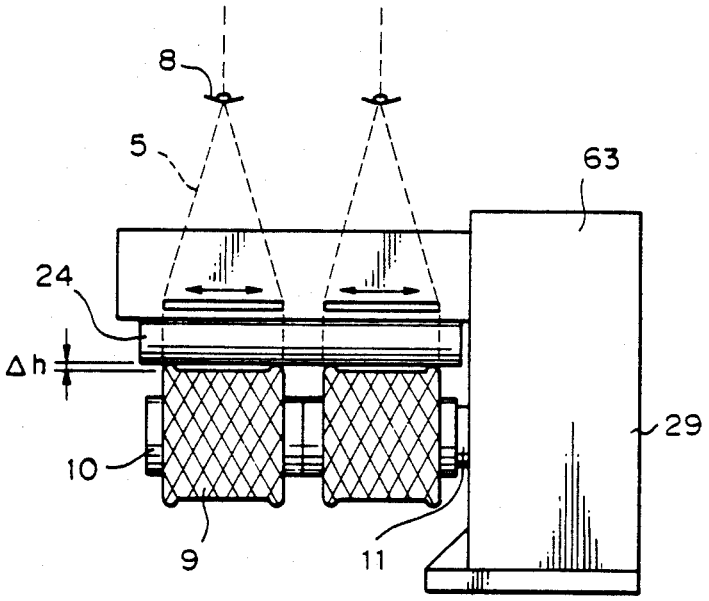
Fig. 5 PRIOR ART
FIG. 5 is a side view of a conventional winder used for manufacturing a synthetic yarn.

As shown in FIG. 4, illustrating a block diagram explaining a controlling apparatus 15 of the winder, signals transmitted from the non-contact type rotational speed detecting device 12, which detects the rotational speed of the contacting roll 24 by sensing the holes of the row of holes 13, are input to a pulse counter 71. The pulse counter 71 integrates the number of holes 13 passed during a measuring time interval output from a measuring timing signal generator 70. A row of clock pulses is transmitted in the order of 1 MHZ from a reference clock generator 74, and a clock counter 72 integrates the number of the clock pulses during the measuring time interval output from the measuring timing signal generator 70. The actual rotational speed of the contacting roll 24 is calculated from the number of holes passed during the time interval and the clock pulses during the time interval by an operational amplifier 73. The actual rotational speed and ideal rotational speed generated from a yarn speed setter 75 are compared by a comparator 76 to obtain the discrepancy between them. A necessary control variable is obtained from the discrepancy, and a control gain is transmitted from a gain setter 78 in accordance with the actual rotational speed through a multiplier 77 and an integrator 79 on the basis of an initial frequency set by an initial yarn speed setter 82. Information of an actual bobbin shaft driving frequency is input from the inverter controller 80 to the gain setter 78, and an actual suitable gain is set on the basis of the above-mentioned information. Then, the frequency for driving the bobbin shaft is determined by an inverter controller 80 on the basis of the control variable and input to the second independent inverter 14 driving the bobbin shaft driving means 26.

As described hereinafter, in the winder in accordance with the present invention, the bobbin shaft driving means 26 is controlled to be reduced in speed so as to maintain constant the winding circumferential speed of the yarn package 9 during winding. This speed reducing control is performed by comparing the detected rotational speed of the contacting roll with the predetermined ideal or target rotational speed. Namely when the diameter of the yarn package increases, the winding circumferential speed or rotation speed of the yarn package increases, when the rotational speed of the yarn package exceeds the target rotational speed, the frequency of the bobbin shaft is immediately controlled by instructions from the controller 15 to decrease the speed of the bobbin shaft driving means 26.

So that the contacting roll 24 is rotated at a constant rotational speed when the yarn is wound at a constant winding speed, it is necessary to hold the contacting roll 24 and the bobbin 10 in a non-contact condition before start of the winding operation and to adjust the frequency and driving force applied to the contacting roll driving means 20 by the first independent inverter 25 which is not operably connected to the controller 15 such that the rotational speed of the contacting roll corresponds to a target winding speed of the yarn. Therefore, it is sufficient that the above-mentioned constant driving force is always supplied to the contacting roll driving means 20. It is unnecessary to make special adjustments for them.

As described hereinbefore, the winder of the present invention is different from the conventional winder in that an individual driving system or independent driving system is adopted for each of the bobbin shaft and the contacting roll. Namely, the bobbin shaft driving means 26 applies a driving force necessary for winding the yarn, comprising a force for rotating the bobbin and the yarn package wound on the bobbin and a force for drawing the yarn, while the contacting roll driving means 20 applies a driving force necessary for rotating the contacting roll 24 through power transmitting devices 21, 22, and 23. Therefore, when the yarn is winding at the constant winding speed, it is possible to maintain at a minimum the rotation transmitting force between the yarn package 9 and the contacting roll 24.

Figure 7:
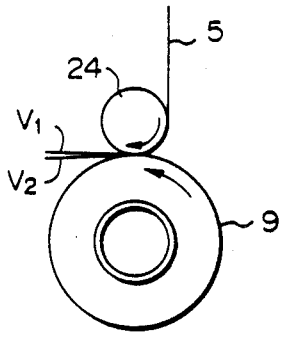
FIG. 7 is a diagram explaining the force acting on a yarn during formation of a yarn package in the winder in accordance with the present invention.

As shown in FIG. 7, illustrating the relationship between a circumferential speed of the contacting roll 24 and a circumferential speed of the yarn package 9 in the winder of the present invention, a yarn 5 is wound onto the yarn package 9 at a winding circumferential speed $V_2$ through the contacting roll 24 rotating at a winding circumferential speed $V_1$. The constant winding speed expressed in this specification means a speed whereby the following equation is satisfied:

Predetermined circumferential speed = Contacting roll circumferential speed ($V_1$) = Winding circumferential speed ($V_2$) Further, it is ideal that there is no change of the winding speed during the winding operation.

However, in the conventional winder adopting the conventional method of dividing the driving force and the conventional method of detecting the winding speed, as disclosed U.S. Pat. No. 4,069,985 and 3,288,383, slippage occurs between the contacting roll and the yarn package and it is impossible to detect the correct circumferential speed of the contacting roll.

In the winder of the present invention, the slippage between the contacting roll and the yarn package is reduced and the contacting roll circumferential speed $V_1$ is made equal to the winding circumferential speed $V_2$ by eliminating the rotation transmitting force between the contacting roll 24 and the yarn package 9. It is thus possible to wind the yarn at a constant winding speed by detecting directly the circumferential speed of the contacting roll 24, i.e., the rotational speed of the contacting roll 24.

Figure 15:
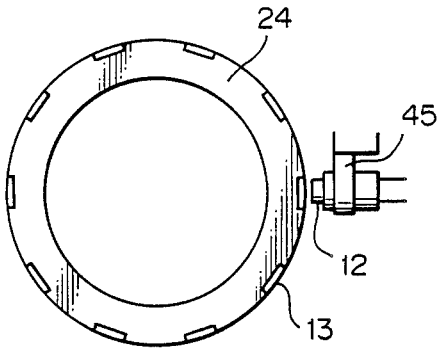
FIG. 15 is a cross sectional view illustrating an embodiment of a multi-hole type rotation detecting means used in the winder in accordance with the present invention.
Figure 16A:
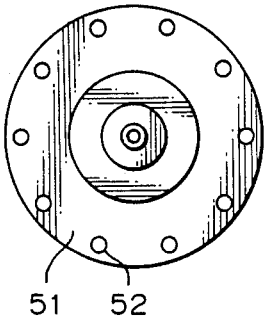
FIG. 16*a* is a front view illustrating an embodiment of a disk of a disk type rotation detecting means used in the winder in accordance with the present invention.
Figure 16B:
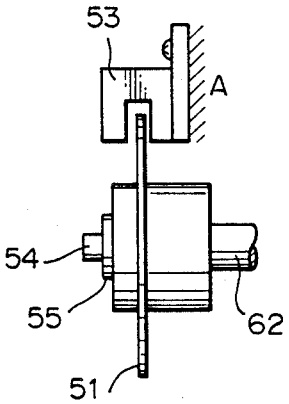
FIG. 16*b* is a side view of the disk illustrated in FIG. 16*a.*

An embodiment of a device for detecting the rotational speed of the contacting roll 24 is illustrated in FIG. 15. In this embodiment, a row of holes 13 is arranged on a circumferential face of the contacting roll 24. Further, as shown in FIG. 16*a* and FIG. 16*b*, a disk 51, attached to the shaft 62 of the contacting roll 24 by means of a washer 55 and a bolt 54 and having a circular row of holes 52, and a detector 53 for detecting existence of the holes 52 may be used as the rotational speed detecting device. In this case, a photoelectric sensor or a magnetic sensor may be used as the detector 53. A plurality of marks such as, projections, colored spots, or grooves arranged equiangularly on an end face of the disk and capable of been detected by the detecting means can be used in place of holes.

If there is no unstable speed difference caused, for example, by slippage of a belt against pulleys, between the contacting roll and the contacting roll driving means 20, detection of the rotational speed of the contacting roll driving means 20 may be adopted in place of the detection of the rotational speed of the contacting roll 24.

Since the above-mentioned rotational speed detecting device of the contacting roll has no mechanical portions contacting other members, safety and reliability factors are substantially increased particularly for high-speed winders where the rotational speed exceeds 10,000 m/min. Incidentally, it has been shown possible to obtain precision rotation of ±0.1% or less at a winding speed of 7,000 m/min or more in the winder of the present invention.

In the embodiment described referring to FIG. 4, the correct rotational speed is obtained by using in parallel the integrated number of the detected holes and the count of the reference clock. However, a detecting system without the reference clock system may be also used. The precision slightly decreases, but it is still capable of being used in practice.

Further, in the embodiment described referring to FIG. 4, a digital system is used as the detecting system, but an analog system may be used for obtaining good control.

The strength of the material constituting the contacting roll or the like, especially the partial stress concentration, becomes a problem at a winding speed of 7,000 m/min or more. For example, a contacting roll suffers from centrifugal stress of about 20 kg/mm$^2$ at a winding speed of 10,000 m/min. Therefore, a high tenacity steel should be adopted as the material of the rollers.

The power consumption at the time of rotating the roller depends on the surface area of the roller. For example, when a roller having a diameter of 100 mm and a length of 800 mm is rotated at a circumferential speed of 10,000 m/min, the power consumption of the roller is about 3.8 kW. Although it is preferable to use a roller having a small diameter for decreasing the power consumption, a roller having a small diameter must be rotated at a high speed to attain the desired circumferential speed of the roller. For example, a roller having a diameter of 100 mm must be rotated at 32,000 rpm to attain a circumferential speed of 10,000 m/min. Therefore, it is particularly preferable to use a roller having the diameter between 80 mm and 120 mm considering the life of the bearings of the roller.

With regard to the lubrication of the bearings, it is preferable to use oil mist lubrication in place of conventional grease lubrication.

It is preferable to use a high-speed three-phase induction motor as the contacting roll driving means. The connection system between the motor and the contacting roll is not limited to the system described in the embodiment. The motor may be directly connected to the contacting roll, or an outer-pole type motor, wherein a rotor is rotated on the outside of a stator, accommodating the contacting roll therein may be used. Further, it is possible to drive the contacting roll by using an air turbine in place of the motor.

Figure 8:
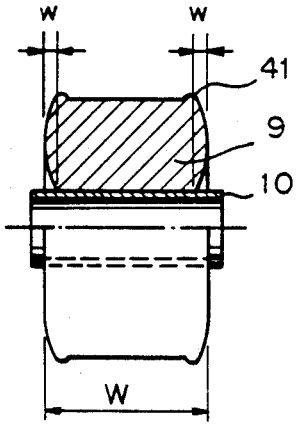
Fig. 8 PRIOR ART
FIG. 8 is a partial sectional view of a conventional yarn package.
Figure 9:
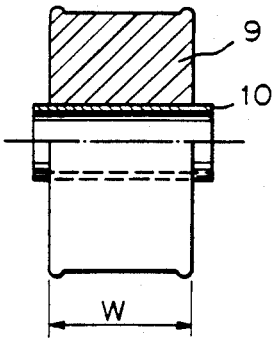
FIG. 9 is a partial sectional view of a yarn package in accordance with the present invention.

The shape of a yarn package wound by a conventional winder is shown in FIG. 8, and the shape of a yarn package wound by the winder of the present invention is shown in FIG. 9. As can been seen comparing FIG. 9 with FIG. 8, the yarn package of the present invention has a good shape with smaller bulges compared with the yarn package of FIG. 8, even with the same winding angle.

Up to now the winding angle in the winder is usually set in the range between 5° and 7°. A yarn package having a low winding angle tends to generate larger bulges. However, a good shape having small bulges can be obtained at the lower winding angle by the present invention. Further it is possible to wind the yarn package at a winding angle of less than 5° by adopting suitable operational conditions.

Therefore, the speed of traverse motion can be decreased by decreasing the winding angle. By this, it becomes possible to hold down the increase of yarn tension at the place where the traverse is returned. Further, it is possible to extend the life of the traverse device, due to the lower speed of operation. Especially, it is possible to extend the life of a guide of a cam type traverse device and improve the yarn quality, a result of the decreased fluctuation in the yarn tension.

Figure 6:
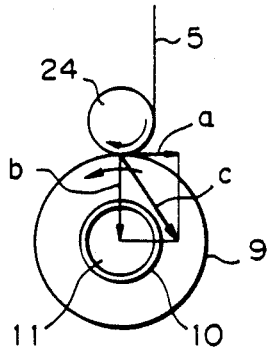
Fig. 6 PRIOR ART
FIG. 6 is a diagram explaining the force acting on a yarn during formation of a yarn package in a conventional winder.

As described hereinafter, since the driving forces of the bobbin shaft 11 and the contacting roll 24 necessary to attain the target winding speed are supplied separately in the winding operation of the present invention, the reversed force a (see FIG. 6) of the rotation transmitting force between the yarn package and the contacting roll is eliminated, enabling a yarn package having good shape without bulges. Further, it is possible to eliminate the contact pressure b (see FIG. 6) previously necessary to generate a rotation transmitting force between the yarn package 9 and the contacting roll 24. The yarn package can be wound by applying only a small contact pressure necessary to hold the yarn to be wound to the cheese package in a desired yarn locus.

We will now describe a multi-track cam type traverse device and a method for winding by means of this traverse device.

The multi-track cam type traverse device used in the winder of the present invention illustrated in FIG. 1 is comprised of a cylindrical traverse cam 19 having an endless spiral guiding groove, a pair of rails 17 arranged along an axial direction of the cylindrical traverse cam, a yarn guide 18, one end of which engages in the guiding groove, and which is moved reciprocatively guided along the pair of rails, a traverse driving device 16, and a traverse driving inverter (not shown in FIG. 1). In this traverse device, the cylindrical traverse cam 19 is rotated by setting a frequency corresponding to a predetermined number of traverse motions to the traverse driving inverter. The yarn guide 18 applies the traverse motion to the yarn 5.

The cylindrical traverse cam of the present invention is formed as a multi-track cam, one of the main constituent features of the winder of the present invention. The multi-track cam is a well-known device, as disclosed in Japanese Examined Patent Publication (Kokoku) No. 50-22130 and Japanese Unexamined Patent Publication (Kokai) No. 60-167855. We will now describe the construction of the multi-track cam referring to FIGS. 10, 11*a*, and 11*b*.

Figure 10:
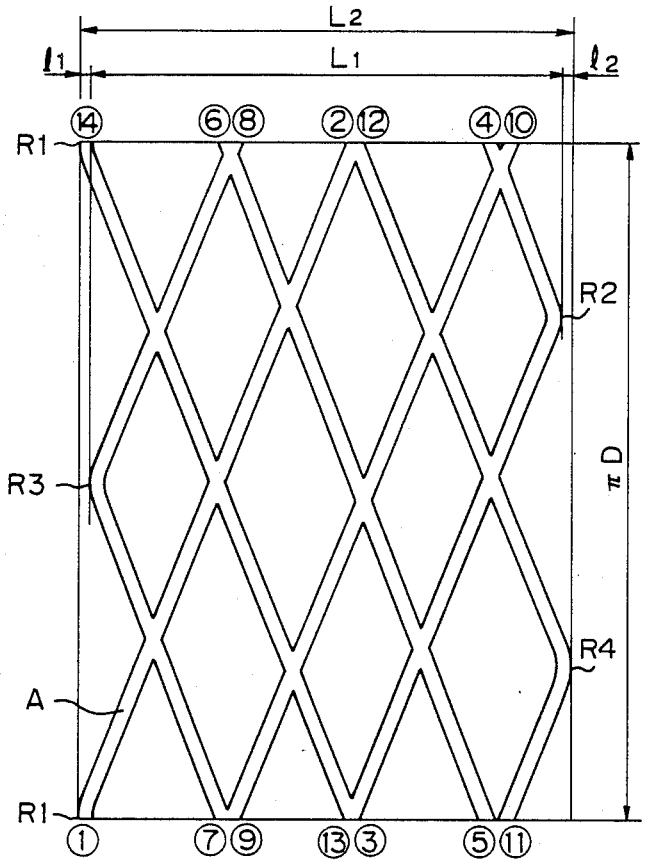
FIG. 10 is a development view of a traverse cam having multi-track grooves used in the winder illustrated in FIG. 1.

As shown in FIG. 10, illustrating an embodiment of the multi-track cam used in the winder of the present invention, a cam groove A of the multi-track cam starts from an optional point on a circumferential surface of the cylindrical traverse cam, e.g. first return point $R_1$ and arrives through points (1), (2), and (3) to a second return point $R_2$. Then the cam groove A continues through points (4), (5), (6), and (7) to a third return point $R_3$. The width $L_1$ of the first reciprocal pathway is formed by movement of the yarn guide between the point (1) and the third return point $R_3$. Further, the cam groove A continues from the third return point $R_3$ through points (8), (9), (10), and point (11), fourth return point $R_4$ and points (12), (13) and (14) to the first return point $R_1$. The width $L_2$ of the second reciprocal pathway is formed. In this case the cam groove A is a multi-track cam groove of two tracks. The width $L_1$ of the first reciprocal pathway is narrower than the width $l_2$ of the second reciprocal pathway by a shortening width $l_2$ in the second return point $R_2$ plus a shortening width $l_1$ in the third return point $R_3$ Namely, the cam groove A is an endless spiral groove consisting of a plurality of inclined pathways, e.g., the pathway from the point (5) to the point (6) or pathway from the point (9) to the point (10), and a plurality of folded pathways, e.g., the pathway from the point (7) to the point (8) and pathway from the point (11) to the point (12). The four return points $R_1$, $R_2$, $R_3$, and $R_4$ are arranged at different places in the axial direction of the cylindrical traverse cam.

Figure 11A:
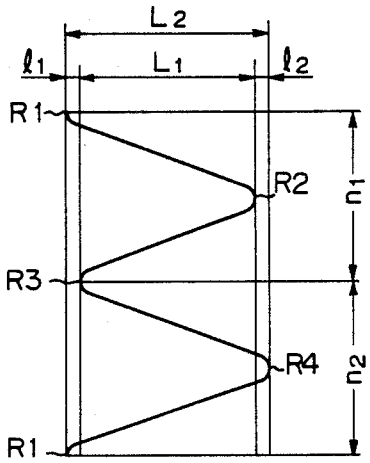
FIG. 11*a* is a diagram explaining an embodiment of a locus of a groove provided on the traverse cam used in the winder illustrated in FIG. 1.

FIG. 11*a* shows a locus of the yarn guide moved reciprocatively along the cam groove A illustrated in FIG. 10. Therefore, the yarn repeats return movements on the return points $R_1$, $R_2$, $R_3$, and $R_4$ to be wound to the yarn package. Therefore, the yarn dwell of the high-edge portions of the yarn package wound by using the two track cam are dispersed in areas having the widths $l_1$ and $l_2$.

Figure 11B:
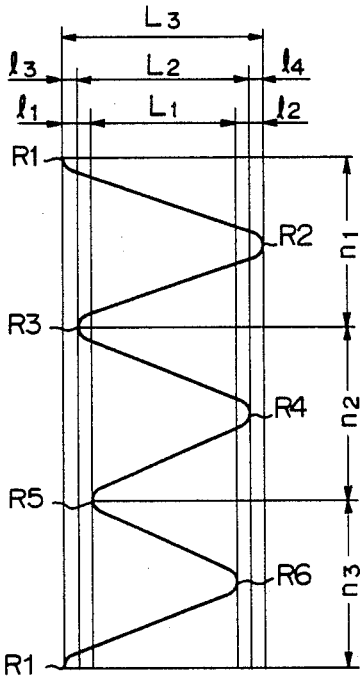
FIG. 11*b* is a diagram explaining another embodiment of a locus of a groove provided on the traverse cam used in the winder illustrated in FIG. 1.

FIG. 11*b* shows a locus of the yarn guide moved reciprocatively along a cam groove of a three-track cam. Regarding the dimensions of widths $L_1$, $L_2$, and $L_3$, the following two combinations can be considered:

$$L_1<L_2<L_3$$

or $$L_1<L_2=L_3$$

Although the number of tracks in the multi-track cam can be arbitrarily selected, it is preferable in practice to select from two to four. Further, although the dimensions of the shortening widths $l_1$, $l_2$, $l_3$, and $l_4$ can be arbitrarily selected, several experiments confirmed that it is necessary to set each shortening width $l_n$ over 2 mm in order to disperse the yarn dwell on the circumferential face of the yarn package.

Figure 13A:
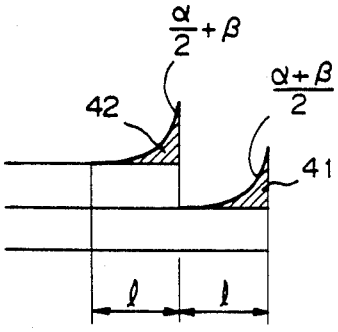
FIG. 13*a* is a diagram explaining generation of yarn dwell portions in the cheese package illustrated in FIG. 12*b;*
Figure 13B:
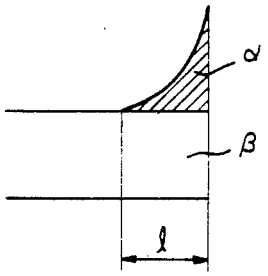
Fig. 13 b PRIOR ART
FIG. 13*b* is a diagram illustrating one yarn dwell portion in the conventional cheese package.

Referring to FIG. 13*a* and FIG. 13*b*, we will now describe the dispersing phenomenon of the yarn dwell caused by using the multi-track cam.

As shown in FIG. 13*b*, since the speed of the yarn in the axial direction of the yarn package is decreased at the point where the yarn is returned, a larger quantity of yarn accumulates at the end portions of the yarn package than the middle portion, resulting in the high-edge portions. Namely, when the yarn quantity caused by the return movement of the yarn is expressed as the mark "$\alpha$" and the yarn quantity caused by the normal movement of the yarn is expressed as the mark "$\beta$", the quantity $\alpha+\beta$ is formed in a range l in FIG. 13*b*. This is the yarn dwell in the conventional yarn package.

FIG. 13*a* shows the yarn dwell of the yarn package formed by using the multi-track cam illustrated in FIG. 11*a*. In this case, the yarn quantity $$\frac{\alpha+\beta}{2}$$

accumulates in a range l at the end portions of the yarn package, as indicated by reference numeral 41, and the yarn quantity $$\frac{\alpha}{2}+\beta$$

accumulates at the portion inward from the end port on of the yarn package, as indicated by reference numeral 42. As can be clearly understood from the above-mentioned description, since the yarn quantity $$\frac{\alpha}{2} + \beta$$

in the yarn dwell 42 is larger than the yarn quantity $$\frac{\alpha + \beta}{2}$$

in the yarn dwell 41, the yarn dwell 42 is formed as a protuberance having a higher hardness than that of the yarn dwell 41, and the high-edge portions are dispersed.

Figure 12A:
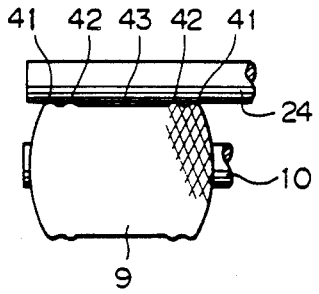
Fig. 12 a PRIOR ART
FIG. 12*a* is a front view illustrating a cheese package wound by a conventional winder in a state contacting with the contacting roll.

To obtain a yarn package free from bulges and wound with a synthetic yarn not resulting in "hikes" and uneven dyeing in the fabric state, it is necessary to combine the multi-track cam and the self-driving contacting roll. For example, when yarn is wound at the speed of 5,000 m/min or more, such that protuberances having a high hardness are formed 2 mm or more inward from the ends of the yarn package by the winder having the multi-track cam and an ordinary frictional driving type contacting roll, the two end faces of the yarn package collapse during the winding operation as shown in FIG. 12*a*, making it impossible to continue the normal winding operation.

Figure 12B:
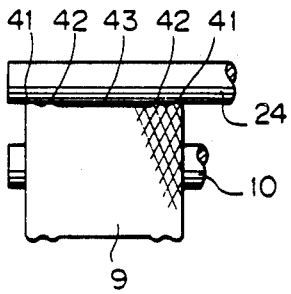
FIG. 12*b* is a front view illustrating a cheese package wound by the winder in accordance with the present invention in the state contacting with the contacting roll.

When the yarn package is formed by a winder having the multi-track cam and the self-driving type contacting roll of the present invention, a yarn package having a square shape, as illustrated in FIG. 12*b*, can be obtained and the yarn constituting the yarn package is excellent in quality, i.e., features little "hikes", uneven dyeing, or the like.

We will now describe a novel cheese yarn package of a synthetic yarn obtained by using the above-mentioned winder and applying the above-mentioned winding method in accordance with the present invention.

The synthetic yarn used in the yarn package of the present invention means synthetic yarn obtained from a thermoplastic polymer having fiber-forming properties, for example, a thermoplastic polyester such as polyethylene terephthalate, or polybutylene terephthalate, a thermoplastic polyamide such as polyhexamethylene adipamide and polycaproamide, or a thermoplastic polyolefin such as polypropylene or polyethylene.

The synthetic yarn in the present invention is directly wound from a spinning portion of a spinning machine without a drawing process and is substantially free of twist, which is different from the twist caused by the rewinding process.

It is preferable that the synthetic yarn have mechanical properties capable of withstanding the knitting or weaving process, because the synthetic yarn is directly withdrawn from the yarn package for the processes. For example, in typical synthetic threads such as the yarn manufactured from polyethylene terephthalate, polyhexamethylene adipamide, and polycaproamide, it is preferable to have a tensile strength of 3 g/d or more and elongation of 90% or less.

The cheese yarn package of the synthetic yarn in accordance with the present invention is characterized in that portions having the highest hardness are formed on the circumferential face of the yarn package inward from the two ends of the yarn package toward a central portion.

Figure 14A:
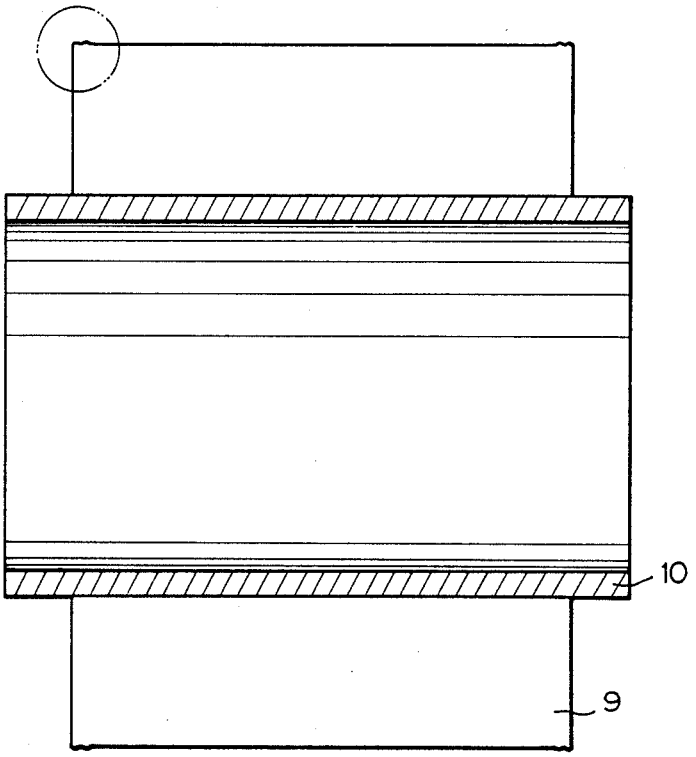
FIG. 14*a* is an enlarged sectional view illustrating especially the circumferential shape of the cheese package illustrated in FIG. 9.
Figure 14B:
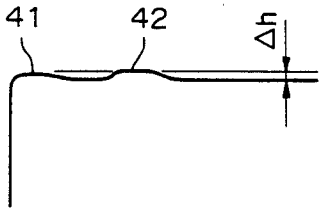
FIG. 14*b* is a partial further enlarged view illustrated in detail a portion of the circumferential shape of the cheese package illustrated in FIG. 14*a;*

FIG. 14*a* is a cross-sectional view of the yarn package 9 wound on a bobbin 10 in accordance with the present invention. As shown in FIG. 14*b*, illustrating an end portion of the circumferential face of the yarn package 9 in an enlarged size, the portion 42 having the highest hardness is a protuberance formed by overlapped yarns. The diameter of this portion is slightly larger than the other portions. The difference of diameter $\Delta h$ between the protuberance and the other portions is preferably in a range between about 0.1 mm and about 3 mm, more preferably between about 0.1 mm and about 1 mm. The suitable width of the protuberance in the axial direction of the yarn package 9 depends on the winding angle of the yarn and contact pressure between the yarn package and the contacting roll, but it is preferable that the width of the protuberance be between about 2 mm and about 20 mm.

To eliminate the generation of "hikes" in the fabric manufactured from the yarn of the yarn package of the present invention, it is preferable that the protuberances be formed at 2 mm or more inward from the end faces of the yarn package, more preferably 4 mm to 15 mm. When there are several protuberances on the circumferential face at the ends of the yarn package, it is not always necessary that each protuberance be positioned inward from each end face by the same distance, but it is preferable that each protuberance be positioned inward from each end face by the same distance to make the locus of traverse easier. If necessary, to further improve the shape of the yarn package, a plurality of protuberances may be used. However, to simplify the mechanism of the traverse device, it is preferable to use two or four protuberances per yarn package, i.e., one or two protuberance for each end portion of the yarn package.

Since the protuberances having the largest diameter and the highest hardness are positioned away from other protuberances and at the ends of the yarn package, as indicated by the reference numerals 41 in FIG. 14*b*, but inward from the ends 41, the tension applied to the yarn at the ends 41 is weakened and the strain of the yarn at the ends 41 is relaxed, so that "hikes" in the fabric state can be eliminated.

The hardness of the yarn package is large and increases from the central portion 43 to the ends 41 and is highest at the protuberances 42. It is preferable that the difference of the hardness between the central portion 43 and the protuberances 42 be as small as possible. The difference may be usually between 5° and 30°. The difference of the hardness between the ends 41 and the protuberances 43 may be between 5° and 20°.

The specific shape of the yarn package described hereinafter is formed at the start of the winding operation and continues to the end of the winding operation. Therefore the yarn package of the present invention returns its excellent shape from a relatively small yarn package, such as a package of a weight of one kg, to a relatively large yarn package, such as a package of a weight of several tens of kilograms.

The cheese yarn package in accordance with the present invention is further characterized in that the difference in the maximum of dry heat shrinkage stress value of the yarn included in the portions having the highest hardness of the yarn package, i.e., in the protuberances, and the maximum of dry heat shrinkage stress value of the yarn included in the central portion is 40 mg/d or less.

When the above-mentioned difference of stress is 40 mg/d or less, it is confirmed that there is little generation of "hike" in the manufactured fabric. The above-mentioned condition of a difference of 40 mg/d or less applies to the yarn at every layer of the yarn package.

To further decrease the generation of "hikes", it is preferable that the difference of stress value be 20 mg/d or less, more preferably 15 mg/d or less.

Incidentally, in the yarn package wound by a winder having a conventional cylindrical single track cam, it is impossible to obtain a yarn having a difference of stress of 40 mg/d or less.

As described in detail hereinafter, a yarn package having excellent qualities of winding shape, dyeing, and resistance to "hikes" in the fabric state can be obtained by using the bobbin driving type winder having the self-driving type contacting roll with the rotational speed control system and the multi-track cam type traverse device in accordance with the present invention.

When this winder is used to wind polyester yarn having a birefringence between 0.08 and 0.14, a crystal perfection index of 0.50 or less, and a shrinkage ratio in boiling water of 5% or less, the obtained yarn package has excellent qualities in winding shape, dyeing, and resistance to "hikes" in the fabric state and further has a good dyeability under normal pressure and dimensional stability.

When the birefringence of the polyester yarn is under 0.08, the yarn of this yarn package does not have sufficient mechanical properties, e.g., strength or elongation, for supply of the yarn from the yarn package to a weaving or knitting machine without drawing process or the like.

When the birefringence of the polyester yarn is over 0.14, it is difficult to obtain the easy dyeability featured by synthetic yarn spun by a high-speed spinning systems. It is preferable to select the birefringence between 0.10 and 0.13 in order to obtain sufficient mechanical properties and easy dyeability.

The crystal perfection index is a characteristic indicating the structure of a crystal region measured by the method described hereinafter. When the crystal perfection index is small, the perfection of the crystal is good and the mechanical properties and the dimensional stability with regard to heat also become good. The crystal perfection index of the polyester yarn of the yarn package wound by the winder in accordance with the present invention is 0.50 or less, so that yarn having a shrinkage ratio in boiling water of 5 or less and an excellent low shrinkage in heating can be obtained.

To further improve the mechanical properties of the polyester yarn and obtain yarn having a shrinkage ratio in boiling water of 3% or less, it is preferable that the crystal perfection index be 0.30 or less.

Before describing several examples proving several effects of the present invention, the relationship between five aspects of the invention, described in detail and claimed in the claims, are clarified in Table 1.

As shown in Table 1, this invention comes in five aspects: two winders, two methods for winding, and a yarn package. The effects are enhanced by combining (1) a self-driving contacting roll with a rotational speed controlling system, (2) multi-track traverse cam, and (3) winding under low contact pressure. The effects of the combination of the three features on properties of the yarn or the yarn package are shown in Table 1.

TABLE 1

| | Combination of system | | | | Effect | | |
|---|---|---|---|---|---|---|---|
| | Self driving contacting roll with rotational speed controlling system | Multi-track traverse cam | Winding under low contact pressure | Example group | Winding shape | Uneven dyeing | Hikes |
| Winder | * | — | — | B | good | best | good |
| | * | * | — | D | better | best | best |
| Method for winding | * | — | * | C | best | best | good |
| | * | * | * | E | best | best | better best |
| Cheese-like yarn package | * | * | — | F.G | good | best | best |
| Prior art | none | none | — | A | bad | bad | bad |

*: used
—: not used

EXAMPLES

The present invention will be explained further by means of examples, which in no way limit the invention. Definitions and measurements of various characteristics used throughout this specification are as follows.

Winding Shape

The width in the axial direction of the yarn package is measured as W, and width of a bulge as w as shown in FIG. 8. The bulge ratio w % is represented by the following equation:

$$\text{Bulge ratio } w\ (\%) = \frac{2w}{W - 2w} \times 100$$

A bulge ration of 10% or less is evaluated as "good" and 5% or less as "best".

Hardness

The hardness is measured by means of a hardness tester for textile goods supplied by Shimadzu Corp., and having a needle of diameter 1.5 mm. Eight measured values of the hardness are prepared by directly pressing the needle of the hardness tester on eight points at equal distances in the circumferential direction of the yarn package. The mean value of the eight values is calculated as the hardness of a specific position of an axial direction of the yarn package.

Uneven Dyeing

Uneven dyeing is measured by using a yarn dye affinity testing system disclosed in the Journal of the Society of Fiber Science and Technology, Japan Vol 33 (1977) No. 9, under the following conditions:

| | |
|---|---|
| Measuring apparatus: | Toray Tester FYL-600 supplied by Toray Co., |
| Running speed of yarn: | 30 m/min |
| Temperature of scouring: | 60° C. |
| Time of Scouring: | 15 sec |
| Temperature of dyeing: | 60° C. |
| Time of dyeing: | 80 sec |
| Sensitivity of measurement: | 1 V |

The 60° C. temperature of dyeing is selected in order to give the most suitable condition for detection of uneven dyeing. Uneven dyeing is expressed as a variance value ($V_{FYL}$) obtained by processing statistically the variation of the degree of exhaustion in the axial direction of the yarn. A small value of $V_{FYL}$ means little uneven dyeing.

A value of $V_{FYL}$ of 0.15 or less is evaluated as "good", and 0.10 or less as "best".

Dry Heat Shrinkage Stress Value

The fact that the stress in a yarn cramped at a constant length is highest in the heat-up process is well known (see Journal of the Society of Fiber Science and Technology, Japan Vol 27 (1971) No. 8).

A dry heat shrinkage stress curve is prepared by using the heat stress measuring apparatus KE-2 supplied by Kanebo Engineering Co. A yarn having 10 cm as the length to be measured is folded to form a loop of 5 cm length. An initial load of 10 mg/d is attached to an end of the loop. The loop is placed into a heating oven. The temperature is increased at a heat-up speed of 150° C./min, and a dry heat shrinkage stress curve of the loop is drawn. The maximum value of the stress obtained from the curve is divided by twice the total denier of the yarn used for the measurement. The maximum of dry heat shrinkage stress value is obtained as F mg/d.

Next, measurements of the F value are performed for yarns sampled from several portions in the axial direction of the yarn package from one end of the yarn package to another end of the same. The measurement is repeated for five traverses, i.e., five pieces of data of the F value are obtained for every portion in the axial direction of the yarn package. The mean value of F value is obtained from the five F values.

The distribution of the mean F values of the various portion in the axial direction of the yarn package corresponds to the distribution of the hardness of the portions of the yarn package. Namely, the mean F value is highest at the place where the hardness of the yarn package is highest.

The difference of the maximum of dry heat shrinkage stress value ΔF is represented by the following equation $$\Delta F = \overline{F}_1 - \overline{F}_2 \ (mg/d)$$

wherein $\overline{F}_1$ stands for the F value at a place where the hardness is highest, and $\overline{F}_2$ stands for the F value at a central position of the yarn package.

Hikes

The "hikes" on a knitted or woven fabric are evaluated on the basis of an organoleptic test standard determined by experiences prevailing in this field by visual inspection of an inspector. The inspected results are evaluated and expressed according to the following scale:

W=0: Little "hikes"
W=1: Extremely small "hikes"
W=2: Hikes
W=3: Large or strong "hikes"

The "hikes" of the evaluated fabric are expressed on the basis of the mean value of the above-mentioned W value evaluated by three inspectors according to the following standard:

W=0: Best
W=0–1: Better
W=1–2: Good
W=2–3: Bad

Birefringence

The refractive index $n_{11}$ to polarized light parallel to the axis of the filament and the refractive index $n_{\perp}$ to polarized light perpendicular to the axis are observed by the interference fringe method using a transmission quantitative interference microscope supplied by Karl-twiesena Co., GDR. In this case, a green ray having a wavelength λ of 549 mμ is used.

The birefringence Δn is represented by the following equation:

$$\Delta n = n_{11} - n_{\perp}$$

Crystal Perfection Index

The diffraction strength curve for 2θ from 7° to 35° is drawn for a specimen having a thickness of 0.5 mm by an X-ray diffraction apparatus under the following conditions:

Electric voltage: 30 kV
Electric current: 80 mA
Scanning speed: 1°/min
Chart speed: 10 m/min
Time constant: 1 sec
Receiving slit: 0.3 mm Three main reflection in the range of 2θ from 17° to 26° are denoted as (100), (010), (1$\bar{1}$0) from a low angle side. A base line is formed by a straight line connecting the diffraction strength curve in the range of 2θ from 7° to 26°. The reflection strength is expressed by a perpendicular line from each peak toward the base line. The crystal perfection index $C_R$ is represented by the following equation:

$$C_R = I_0/I$$

where $I_0$ is the reflection strength corresponding to a valley between (010) and (1$\bar{1}$0) and I is the reflection strength corresponding to a peak of (1$\bar{1}$0).

Shrinkage Ratio in Boiling Water

A length $L_0$ of a specimen is measured under a weight of 0.1 g/d. The specimen is immersed in a free state in boiling water and treated for 30 min. After that, the length L of the treated specimen is measured under the same conditions. The shrinkage ratio in boiling water is represented by the following equation:

$$\text{Shrinkage ratio in boiling water} = \frac{L_0 - L}{L_0} \times 100$$

Dyeing Affinity

A polyester filament is dyed by a disperse dye Resolin Blue FBL supplied by Bayer Co., under conditions of 3% owf, a bath ratio of 1 to 50, a temperature of 100° C., and a dyeing time of 120 min. The degree of dye absorption is observed by measuring the absorbance of a dyeing liquid after the dyeing operation.

A dyeing affinity wherein the degree of dye absorption is 60% or more is evaluated as "good", and a dyeing affinity wherein the degree of dye absorption is 70% or more is evaluated as "best".

Example Group A

Example group A is a reference group for explaining examples of high-speed winding performed by means of a conventional bobbin driving type winder having a follow driving type contacting roll.

Polyethylene terephthalate having an inherent viscosity of 0.61 and including titanium oxide of 0.5 wt % is extruded at a speed of 7,000 m/min by means of a spinning machine illustrated in FIG. 1 and including a spinneret having 36 holes with a diameter of 0.23 mm, a heating cylinder having a length of 30 cm, and a high speed winder arranged 3 m below an underside of a spinneret, thus giving polyethylene telephthalate filament of 75 denier and 36 filaments. The temperature of the spinning head, including the spinneret, is 300° C., and the temperature of the area in the heating cylinder, i.e., the temperature of the heating zone, is 250° C. The oiling nozzle guide is positioned 25 cm below the point where the thinning treatment of each filament is completed.

A conventional winder provided with a contacting roll with no self-driving force i.e., a follow driving type contacting roll, is used to wind the yarn extruded from the spinneret into a yarn package having the weight of 10 kg under the following conditions:

Outside diameter of bobbin: 140 mm
Length of bobbin: 210·mm
Stroke of traverse: 160 mm
Winding tension: 0.25 g/d
Winding angle: 6°
Contact pressure on winding: 0.25 kg/cm A plain weave fabric having a warp density of 100 per inch and a weft density of 80 per inch is woven by means of a Nissan water jet loom LW-51, using directly a yarn withdrawn from the above-mentioned yarn package as a weft. After scouring and presetting, this fabric is dyed at temperature of 130° C. to prepare a sample to evaluate the "hikes" on the fabric.

Table 2 compares the properties of the yarn prepared by changing the contact pressure and the fabric woven by using the yarn package.

Table 2 shows that high-speed winding using a conventional bobbin driving type winder having a follow driving type contacting roll requires high contact pressure and features unsuitable winding shape, uneven dyeing, and "hikes".

TABLE 2

| Driving system of contacting roll | Contact pressure (kg/width (cm) of yarn package) | Bulge ratio w %) | Uneven dyeing ($V_{FYL}$) | Difference of dry heat shrinkage stress value ΔF (mg/d) | Hikes (W) | General evaluation |
|---|---|---|---|---|---|---|
| Following Type Contacting Roll | 0.35 | 18 | 0.35 | 82 | 3 or more | bad |
| | 0.3 | 15 | 0.25 | 65 | 3 or more | bad |
| | 0.2 | 13 | 0.23 | 55 | 3 | bad |
| | 0.15 | no winding | — | — | — | bad |

Example Group B

Example group B relates to high-speed winding by means of a bobbin driving type winder having a self-driving type contacting roll with a rotational speed control system in accordance with the present invention.

Polyethylene terephthalate having an inherent viscosity of 0.61 and including 0.5 wt % of titanium oxide is extruded at a temperature of 295° C. by means of the spinning machine illustrated in FIG. 1 and including a spinneret having 36 holes with a diameter of 0.23 mm, a heating cylinder having a length of 30 cm, and the above-mentioned high-speed winder arranged 3 m below the spinneret, thus giving a polyethylene telephthalate filament of 75 denier and 36 filaments. The oiling nozzle guide is positioned 25 cm below the point where the thinning treatment of each filament is completed.

The winding conditions of the above-mentioned winder in accordance with the present invention are as follows.

Outside diameter of bobbin: 140 mm
Length of bobbin: 210 mm
Stroke of traverse: 160 mm
Winding angle: 6°
Contact pressure on winding: 0.12 kg/cm
Weight of yarn package: 10 kg Table 3 compares the properties of the yarn packages prepared by changing the spinning or winding speed and the fabric woven by the same manner as in Example Group A.

Table 3 shows that the bobbin driving type winder having the self-driving type contacting roll with the rotational speed control system in accordance with the present invention can provide a cheese yarn package having excellent winding shape, excellent uneven dyeing, and improved "hikes" of the fabric manufactured using this yarn package. The improvement of the uneven dyeing and "hikes" are obtained at all portions from the outside layer to the inside layer of the yarn package.

TABLE 3

| No. | Winding Speed (m/min) | Bulge ratio (w %) | Uneven dyeing ($V_{FYL}$) | Difference of dry heat shrinkage stress value ΔF (mg/d) | Hikes (W) | General evaluation |
|---|---|---|---|---|---|---|
| 1 | 5500 | 4 | 0.04 | 30 | 1 | better |
| 2 | 6500 | 5 | 0.04 | 34 | 2 | good |
| 3 | 7500 | 7 | 0.05 | 35 | 2 | good |
| 4 | 8000 | 8 | 0.06 | 38 | 2 | good |

Example Group C

Example Group C relates to high speed winding performed under a condition of low contact pressure by means of a bobbin driving type winder having a self-driving type contacting roll with a rotational speed control system in accordance with the present invention.

Several yarn packages of a weight of 10 kg are prepared by changing the contact pressure under the same conditions as used in Example Group B, except that the winding speed is fixed to 7,000 m/min.

Table 4 compares the properties of the yarn packages, and the fabrics woven in the same manner as in Example Group A.

Table 4 shows that winding under low contact pressure, which cannot be used in the prior art, can be attained in at a high speed of 7,000 m/min by using the bobbin driving type winder having the self-driving type contacting roll with the rotational speed control system in accordance with the present invention.

TABLE 4

| No. | Contact pressure (kg/width (cm) of yarn package) | Bulge ratio (w %) | Uneven dyeing ($V_{FYL}$) | Difference of dry heat shrinkage stress value ΔF (mg/d) | Hikes (W) | General evaluation |
|---|---|---|---|---|---|---|
| 5 | 0.2 | 8 | 0.14 | 38 | 2 | good |
| 6 | 0.15 | 6 | 0.06 | 35 | 2 | good |
| 7 | 0.10 | 3 | 0.05 | 31 | 1 | better |
| 8 | 0.05 | 3 | 0.04 | 25 | 1 | better |

Example Group D

Example Group D relates to high-speed winding performed by means of a bobbin driving type winder having a self-driving type contacting roll with a rotational speed control system and a multi-track cam type traverse device in accordance with the present invention. In Example Group D, properties of a yarn package obtained by the above-mentioned winding are examined in detail.

Polyethylene terephthalate having an inherent viscosity of 0.60 and including a 0.5 wt % of titanium oxide is extruded at a temperature of 295° C. and a speed of 7,000 m/min by means of the spinning machine illustrated in FIG. 1 and including a spinneret having 36 holes with a diameter of 0.23 mm, a heating cylinder having a length of 30 cm, and a high speed bobbin driving type winder arranged 3 m below the spinneret and having the self-driving type contacting roll with the rotational speed control system and three-track cam type traverse device shown in FIG. 11*b*, thus obtaining a yarn package, having a weight of 10 kg of polyethylene telephthalate filament of 75 denier and 36 filaments. The oiling nozzle guide is positioned 25 cm below the point when the thinning treatment of each filament is completed. The filament has a strength of 4.2 g/d and elongation of 40%.

The locus of traverse motion satisfying the equation $L_1 < L_2 = L_3$ in FIG. 11*b* is used and the distances $l_1$ and $l_2$ between the ends of the multi-track cam and the return points of traverse motion are changed as described in Table 5.

Other winding conditions in this Example Group D are as follows:

Outside diameter of bobbin: 140 mm
Length of bobbin: 210 mm
Stroke of traverse: 160 mm
Winding angle: 6°
Winding tension: 0.25 g/d
Contact pressure on winding: 0.25 kg/cm Table 5 compares the properties of the yarn packages and the fabrics woven in the same manner as Example Group A.

Table 5 shows that the bobbin driving type winder having a self-driving type contacting roll with the rotational speed control system and the multi-track cam type traverse device in accordance with the present invention can provide a cheese yarn package having excellent qualities in the winding shape, uneven dyeing and "hikes" in the fabric state. Those improved quality features prevail from the inside layer to outside layer of the yarn package.

TABLE 5

| No. | Distance between two return points of cam $l_1 = l_2$ (mm) | Distance between protuberance and end of yarn package $m_1 = m_2$ (mm) | Bulge ratio (%) | Uneven dyeing ($V_{FYL}$) | Hardness (degree) End | Hardness (degree) Protuberance | Hardness (degree) Central portion | Difference of diameter of yarn package Δh (mm) | Difference of dry heat shrinkage stress value ΔF (mg/d) | Hikes (W) | General evaluation |
|---|---|---|---|---|---|---|---|---|---|---|---|
| 9 | 2 | 2 | 7 | 0.10 | 82 | 90 | 77 | 0.3 | 32 | 1 | best |
| 10 | 5 | 4 | 7 | 0.10 | 81 | 91 | 78 | 0.4 | 27 | 0–1 | best |
| 11 | 8 | 7 | 8 | 0.09 | 82 | 92 | 77 | 0.4 | 25 | 0–1 | best |
| 12 | 12 | 11 | 8 | 0.09 | 81 | 92 | 77 | 0.3 | 22 | 0 | best |
| 13 | 15 | 14 | 9 | 0.08 | 78 | 92 | 78 | 0.5 | 22 | 0 | best |

Reference examples of yarn packages are formed, changing the distances $l_1$ and $l_2$ between the ends of the yarn package and return points of traverse motion to 3 mm or 5 mm, by means of a conventional bobbin driving type winder having a follow driving type contacting roll and three-track cam type traverse device. However in the process of winding those yarn packages, the packages collapsed in winding shape from the time when the yarn was wound onto a yarn package having a weight of about 0.5 kg, making continuation of the winding difficult.

Example Group E

Example Group E is for explaining the effect of changing the contact pressure during the winding operation described in Example Group D.

Four examples are prepared, changing the contact pressure as described in Table 6, under the conditions used in the winding process of the yarn package of Example 10 in Example Group D.

Table 6 compares the properties of the yarn packages and the fabrics woven in the same manner as Example Group A.

Table 6 shows that winding under low contact pressure, which cannot be evaluated in the prior art, can be attained by using the winder described in Example Group D. The obtained yarn package has excellent qualities in winding shape, uneven dyeing, and "hikes" in the fabric state. Those improved quality features prevail from the inside layer to the outside layer of the yarn package.

TABLE 6

| No. | Contact pressure (kg/width (cm) of yarn package) | Bulge ratio (%) | Uneven dyeing ($V_{FYL}$) | Hardness (degree) End | Hardness (degree) Protuberance | Hardness (degree) Central portion | Difference of diameter of yarn package Δh (mm) | Difference of dry heat shrinkage stress value ΔF (mg/d) | Hikes (W) | General evaluation |
|---|---|---|---|---|---|---|---|---|---|---|
| 14 | 0.2 | 7 | 0.08 | 80 | 92 | 77 | 0.6 | 19 | 0 | best |
| 15 | 0.15 | 5 | 0.07 | 80 | 92 | 74 | 0.7 | 15 | 0 | best |
| 16 | 0.10 | 3 | 0.05 | 79 | 91 | 73 | 0.9 | 12 | 0 | best |
| 17 | 0.05 | 3 | 0.05 | 73 | 90 | 73 | 1.3 | 11 | 0 | best |

Table 7 compares the properties of the obtained threads, the yarn packages, and the fabrics woven in the same manner as Example Group A.

Table 7 shows that, even if yarn is extruded at the spinning speed of 6,000 m/min or more, the obtained yarn package of polyester yarn has a good winding shape and dyeing properties for normal pressure dyeing, and the fabric obtained by weaving the yarn from those yarn packages have a good grade with no "hikes".

TABLE 7

| No. | Spinning speed (m/min) | Strength (y/d) | Elongation (%) | Shrinkage ratio in boiling water (%) | Birefringence $\Delta n \times 10^{-3}$ | Crystal perfection index $C_R$ | Dyeing affinity (%) | Uneven dyeing ($V_{FYL}$) | Bulge ratio (%) | Hardness (degree) End | Hardness (degree) Protuberance | Hardness (degree) Central portion | Difference of dry heat shrinkage stress value ΔF (mg/d) | Hikes (w) |
|---|---|---|---|---|---|---|---|---|---|---|---|---|---|---|
| 18 | 5000 | 3.6 | 91 | 13.2 | 0.07 | 0.83 | 55 | 0.03 | 3 | 80 | 86 | 80 | 9 | 0 |
| 19 | 6000 | 3.9 | 55 | 3.4 | 0.10 | 0.44 | 62 | 0.03 | 4 | 83 | 90 | 80 | 13 | 0 |
| 20 | 6500 | 4.1 | 48 | 3.0 | 0.11 | 0.30 | 68 | 0.06 | 7 | 82 | 92 | 77 | 15 | 0–1 |
| 21 | 7500 | 4.1 | 33 | 2.4 | 0.11 | 0.19 | 79 | 0.11 | 8 | 80 | 94 | 78 | 16 | 0–1 |
| 22 | 8000 | 3.8 | 26 | 2.2 | 0.10 | 0.14 | 85 | 0.13 | 9 | 80 | 95 | 80 | 19 | 0 |

Example Group F

Example Group F is for explaining yarn packages of polyester yarn manufactured by a high-speed spin take-up method, capable of dyeing under normal pressure and capable of manufacturing a fabric in which "hikes" are eliminated.

Polyethylene terephthalate having an inherent viscosity of 0.61 and including 0.5 wt % of titanium oxide is extruded at a temperature of 300° C., changing the spinning speed or the winding speed, by means of the spinning machine illustrated in FIG. 1 and including a spinneret having 36 holes with a diameter of 0.23 mm, a heating cylinder having a length of 30 cm, and a high-speed winder arranged 3 m below the spinneret, thus directly obtaining a cheese yarn package, having a weight of 12 kg, of a polyethylene telephthalate filament of 75 denier and 36 filaments. The oiling nozzle guide is positioned 20 cm below the point where the thinning treatment of each filament is completed for every spinning speed. The temperature of the area in the heating cylinder, i.e., the temperature of the heating zone, is 250° C.

The used winder is equipped with a self-driving type contacting roll with a rotational speed control system and a two-track cam type traverse device illustrated in FIG. 11*a*, the distances $l_1$ and $l_2$ between each end of the multi-track cam and each return point of traverse motion being 4 mm. The other winding conditions are the same as that of Example Group D.

The protuberances of the obtained yarn package are 5 mm from the ends of the yarn package, and the winding shape of the yarn package during winding is kept stable.

Example Group G

Example Group G is for explaining yarn packages of polycaproamide yarn wound by means of the winder in accordance with the present invention.

Polycaproamide having an relative viscosity of 2.4, measured by sulfuric acid of 95%, is extruded at temperature of 270° C. The extruded yarn is cooled, passed through a pair of godet rolls with the same circumferential speeds and directly wound at the different spinning speeds or winding speeds described in Table 8 into yarn packages of polycaproamide yarn having a denier of 50 and 17 filaments.

The used winder is equipped with a self-driving type contacting roll with a rotational speed control system and a three-track cam type traverse device illustrated in FIG. 11*b*. A locus of traverse motion satisfying the equation $L_1 < L_2 = L_3$ is used, and the distances $l_1$ and $l_2$ between each end of the multitrack cam and each return point of traverse motion are 3 mm.

The other winding conditions in this Example Group G are the same as in Example Group D, except that the winding contact pressure is set to 0.15 kg/cm.

The protuberances of the obtained yarn package are positioned 4 mm from the ends of the yarn package, and the winding shape of the yarn package during winding is kept stable.

A plain weave fabric is obtained by using a conventional polycaproamide yarn as a warp yarn and using a yarn directly drawn from the above-mentioned yarn package as a weft yarn, at a density of 105 per inch. After scouring and presetting, this fabric is dyed at a temperature of 100° C. to prepare a sample to evaluate "hikes" on the fabric.

Table 8 compares the properties of the obtained yarn prepared by changing the spinning speed or the winding speed, the yarn package, and the fabric woven by using the yarn package.

Table 8 shows that, even if the cheese yarn package of polycaproamide yarn is wound at a high speed, the yarn package has excellent winding shape, and the fabric obtained by weaving the yarn from the yarn package has a good grade free of "hikes".

TABLE 8

| No. | Winding speed (m/min) | Properties of yarn Strength (g/d) | Properties of yarn Elongation (%) | Bulge ratio (%) | Hardness (degree) End | Hardness (degree) Protuberance | Hardness (degree) Central portion | Difference of dry heat shrinkage stress value ΔF (mg/d) | Hikes (w) |
|---|---|---|---|---|---|---|---|---|---|
| 23 | 4000 | 3.8 | 71 | 4 | 83 | 87 | 77 | 14 | 0 |
| 24 | 4500 | 4.2 | 65 | 5 | 82 | 87 | 76 | 20 | 0 |
| 25 | 5000 | 4.5 | 55 | 5 | 81 | 88 | 77 | 22 | 1 |
| 26 | 6000 | 4.5 | 48 | 5 | 79 | 90 | 77 | 25 | 1 |
| 27 | 7000 | 4.6 | 42 | 7 | 80 | 90 | 78 | 27 | 1 |

We claim:

1. A winder for winding a synthetic yarn at a constant speed, comprised of:

a bobbin shaft having a bobbin mounted thereon for winding a synthetic yarn;

bobbin shaft driving means, operably connected to a first inverter, for rotating said bobbin shaft;

a traverse device for traversing a yarn supplied to said bobbin;

a contacting roll arranged in a direction parallel to an axis of said bobbin shaft such that said contacting roll is movable into contact with a circumferential face of a yarn package wound on said bobbin;

contacting roll driving means, operably connected to a second inverter independent of said first inverter, for rotating said contacting roll;

rotational speed detecting means for detecting a rotational speed of said contacting roll; and controller means, connected electrically with said bobbin shaft driving means and said rotational speed detecting means, for controlling a rotational speed of said bobbin shaft through said bobbin shaft driving means in accordance with said detected rotational speed of said contacting roll; and said second independent inverter not being connected to said controller means.

2. A winder according to claim 1, characterized in that said controller includes first counter means for counting signals from a rotational speed detecting device in accordance with a signal from a measuring timing signal generator, second counter means for counting signals from a clock generator in accordance with said signal from said measuring timing signal generator, operational amplifier means for calculating a winding speed of the yarn in accordance with said two signals emitted by said two counters, respectively, comparator means for comparing said winding speed with a signal from a thread speed setter, and means for calculating an optimum control condition of a bobbin shaft driving means in accordance with signals emitted from said comparator and for emitting signals based on said optimum control condition, wherein said clock generator comprises a reference clock generator having a high frequency 3. A winder for winding a synthetic yarn at a constant speed, characterized in that said winder is comprised of:

a bobbin shaft having a bobbin mounted thereon for winding a synthetic yarn;

bobbin shaft driving means, operably connected to a first inverter, for rotating said bobbin shaft;

a traverse device comprising a cylindrical multi-track cam with a circumferential face arranged with an endless groove consisting of a plurality of inclined pathways and a plurality of folded pathways, each said folded pathway having a return point connected with a respective one of said inclined pathways, said return points of said folded pathways being arranged at different positions with respect to one another in the axial direction of said cylindrical cam;

a contacting roll arranged in a direction parallel to an axis of said bobbin shaft such that said contacting roll is movable into contact with a circumferential face of a yarn package wound on said bobbin;

contacting roll driving means, operably connected to a second inverter independent of said first inverter, for rotating said contacting roll;

rotational speed detecting means for detecting a rotational speed of said contacting roll; and controller means, connected electrically with said bobbin shaft driving means and said rotational speed detecting means, for controlling a rotational speed of said bobbin shaft through said bobbin shaft driving means in accordance with said detected rotational speed of said contacting roll; and said second independent inverter not being connected to said controller means.

4. A winder according to claim 3, characterized in that a winding angle of said yarn package wound by said multi-track cam is 7° or less.

5. A winder according to claim 3, wherein said multi-track cam includes at least two tracks.

6. A winder according to claim 3, characterized in that said controller includes first counter means for counting signals from a rotational speed detecting device in accordance with a signal from a measuring timing signal generator, second means for counting the signals from a clock generator in accordance with said signal from said measuring timing signal generator, operational amplifier means for calculating a winding speed of the yarn in accordance with said two signals emitted by said two counters, respectively, comparator means for comparing said winding speed with a signal from a thread speed setter, and means for calculating an optimum control condition of a bobbin shaft driving means in accordance with signals emitted from said comparator and for emitting signals based on said optimum control condition, wherein said clock generator comprises a reference clock generator having a high frequency.

7. A cheese yarn package of synthetic yarn having substantially no twists, said package having higher hardness portions spaced inwardly from the ends toward a central portion of said yarn package in a longitudinal direction of said yarn package on a circumferential face of said yarn package, and the difference between the maximum of dry heat shrinkage stress value of yarn included in said higher hardness portions and the maximum of dry heat shrinkage stress value of yarn included in said central portion is less than about 40 mg/d.

8. A cheese yarn package according to claim 7, wherein said yarn is a polyester yarn having a birefringence between 0.08 to 0.14, a crystal perfection index of less than about 0.50, and a shrinkage ratio in boiling water of less than about 5%, said higher hardness portions being spaced about 2 mm inward from respective ends of said yarn package toward the central portion of said yarn package in the longitudinal direction of said yarn package, and the difference between the maximum of dry heat shrinkage stress values of yarn in said higher hardness portions and yarn in said central portion is less than about 30 mg/d.

9. A cheese yarn package according to claim 7, wherein said yarn is a polyester yarn having a birefringence between 0.08 to 0.14, a crystal perfection index of less than about 0.50, and a shrinkage ratio in boiling water of less than about 5%, said higher hardness portions being spaced at least 2 mm inward from the ends of the yarn package toward the central portion of said yarn package in the longitudinal direction of said yarn package, and the difference between the maximum of dry heat shrinkage stress value of yarn included in said higher hardness portions and yarn included in said central portion is less than about 20 mg/d.

10. A method for winding a yarn, at a constant speed of at least about 5,000 m/min, into a cheese yarn package, comprising the steps of:

rotating, via a first electrically powered drive means and associated first independent inverter, a contacting roll at a target winding speed;

rotating, via a second electrically powered drive means and associated second independent inverter, a bobbin mounted on a bobbin shaft to wind the yarn onto the bobbin;

contacting the outer surface of the contacting roll with the outer surface of the yarn package at a contact pressure of less than about 0.2 kg/cm;

detecting the rotational speed of the contacting roll in contact with the yarn package; and controlling the rotational speed of the bobbin and bobbin shaft in accordance with the detected rotational speed of the contacting roll to maintain the circumferential velocity of the outer surface of the contacting roll substantially constant and equal to the target winding speed, said target winding speed corresponding to the circumferential velocity of the outer surface of the yarn package wound on the bobbin; and independently rotating the contacting roll via the first independent inverter so that a torque applied from the outer surface of the yarn package to the contacting roll is minimized.

11. A method for winding a yarn, at a constant speed of at least about 5,000 m/min, into a cheese yarn package, comprising the steps of:

rotating, via a first electrically powered drive means and associated first independent inverter, a contacting roll at a target winding speed;

rotating, via a second electrically powered drive means and associated second independent inverter, a bobbin mounted on a bobbin shaft to wind the yarn onto the bobbin;

contacting the outer surface of the contacting roll with the outer surface of the yarn package at a contact pressure of less than about 0.2 kg/cm;

guiding the yarn onto the bobbin with a multi-track cam traverse device;

forming a pair of end portions on the wound yarn package having a higher hardness than the remainder of the wound yarn package by periodically returning a traverse motion of the multi-track cam device at said pair of end portions;

detecting the rotational speed of the contacting roll in contact with the yarn package; and controlling the rotational speed of the bobbin and bobbin shaft in accordance with the detected rotational speed of the contacting roll to maintain the circumferential velocity of the outer surface of the contacting roll substantially constant and equal to the target winding speed, said target winding speed corresponding to the circumferential velocity of the outer surface of the yarn package wound on the bobbin; and independently rotating the contacting roll via the first independent inverter so that a torque applied from the outer surface of the yarn package to the contacting roll is minimized.

12. The method of claim Il, wherein said pair of end portions having a higher hardness are spaced at least 2 mm from respective ends of the wound yarn package.

* * * * *